United States Patent [19]

Straumann et al.

[11] 4,338,076

[45] Jul. 6, 1982

[54] OIL BURNER FOR LOW HEATING CAPACITIES

[76] Inventors: Fritz Straumann, Hauptstrasse, Waldenburg; Franz Sutter, Bennwilerstrasse, Niederdorf, both of Switzerland

[21] Appl. No.: 61,202

[22] PCT Filed: Dec. 29, 1978

[86] PCT No.: PCT/EP78/00028

§ 371 Date: Aug. 30, 1979

§ 102(e) Date: Jul. 27, 1979

[87] PCT Pub. No.: WO79/00468

PCT Pub. Date: Jul. 26, 1979

[30] Foreign Application Priority Data

Dec. 30, 1977 [DE] Fed. Rep. of Germany ..... 2759004

[51] Int. Cl.[3] ..... F23Q 3/00

[52] U.S. Cl. ..... 431/351; 431/265; 431/278; 239/406

[58] Field of Search ..... 431/265, 351, 278, 285; 239/406, 404

[56] References Cited

U.S. PATENT DOCUMENTS

| | | | |
|---|---|---|---|
| 1,953,483 | 4/1934 | Higinbotham | 431/265 |
| 3,309,027 | 3/1967 | Chadwick et al. | 239/406 |
| 3,694,135 | 9/1972 | Dancy et al. | 431/265 |

FOREIGN PATENT DOCUMENTS

| | | |
|---|---|---|
| 1451447 | 1/1969 | Fed. Rep. of Germany . |
| 2326323 | 5/1973 | Fed. Rep. of Germany . |
| 2403486 | 8/1975 | Fed. Rep. of Germany . |
| 2433921 | 2/1976 | Fed. Rep. of Germany . |
| 2279025 | 2/1976 | France . |
| 575573 | 5/1976 | Switzerland . |
| 986813 | 3/1965 | United Kingdom . |
| 1082197 | 9/1967 | United Kingdom . |

*Primary Examiner*—Carroll B. Dority, Jr.
*Attorney, Agent, or Firm*—Jordan and Hamburg

[57] ABSTRACT

An oil burner comprises an oil conveying device, an air blower and a burner head, the burner head including a substantially cylindrical burner tube having an outlet orifice at one end, the burner tube tapering towards the orifice, a burner nozzle situated in the burner tube and having a plurality of supporting arms, and a baffle plate attached to and supported by the supporting arms of the burner nozzle. The burner nozzle is tapered towards an end of the outlet orifice of the burner tube to form a frustoconical end zone at the front end thereof. The baffle plate is of a cup shape and is arranged in the burner tube in front of the burner nozzle with the interior thereof pointing to the outlet orifice of the burner tube. The baffle plate includes a bottom zone conically widening towards the outlet orifice of the burner nozzle and having a central opening with a diameter equal to or larger than that of the burner nozzle, and an edge shell around the bottom zone widening towards the outlet orifice of the burner tube so that an annular gap is defined between a front end of the edge shell of the baffle plate and the inner face of the burner tube.

16 Claims, 4 Drawing Figures

FIG. 1
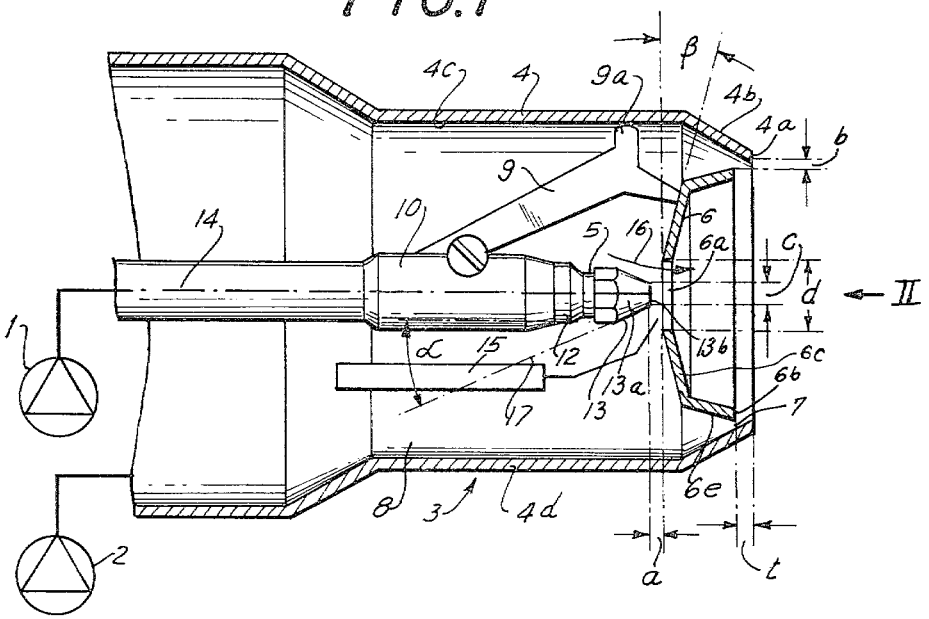
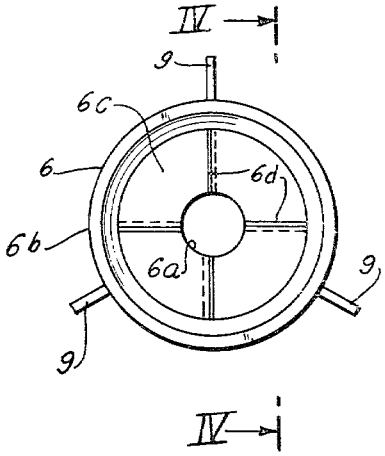
FIG. 2
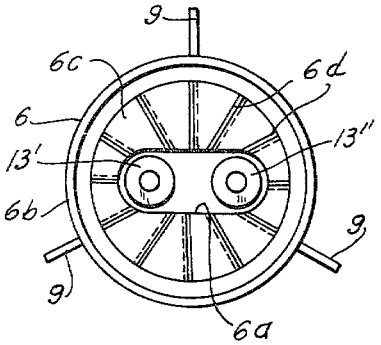
FIG. 3
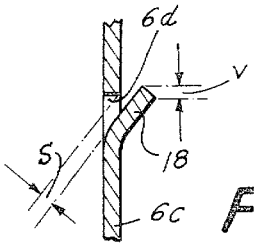
FIG. 4

OIL BURNER FOR LOW HEATING CAPACITIES

The invention relates to an oil burner for low heating capacities, particularly for heating capacities ranging from approximately 12 to 30 Mcal/h, and comprising an oil conveying device, an air blower and a burner head which comprises a substantially cylindrical burner tube with a section tapering towards its outlet orifice and a burner nozzle arranged in the burner tube as well as a baffle plate which is provided with a central opening and which is arranged in the burner tube so that its outer edge is situated in the area of the tapering section and so that an annular clearance exists between the baffle plate and the inner surface of the burner tube.

Such burners for low heating capacities present considerable problems with respect to attaining an adequate combustion quality and, bound up therewith, a good utilisation of the fuel fed to the oil burner and a correspondingly high efficiency.

Until a solution was found by CH patent specification No. 575 573, it had to be accepted in oil heating engineering that the combustion efficiency of low heating capacity oil burners is substantially lower than that of burners having a relatively high heating capacity. The carbon dioxide proportion of the waste gases serves as a measure for the combustion efficiency. The conditions of oil burners for higher or even normal heating capacities, namely heating capacities above 50 Mcal/h, cannot be transferred to oil burners for low heating capacities. In fact, it has turned out that on prior art burner heads for oil burners of a heating capacity below 50 Mcal/h the diameter at the mouth end is much too large in relation to the amount of air required for combustion and that the opening in the baffle plate is also proportionally much larger than it is on oil burners having a high heating capacity. The low combustion efficiency is primarily caused by the fact that the pressure in the burner tube, and accordingly also the flow rate of the air in the mixing zone, is substantially less in smaller oil burners than in relatively large oil burners. A dimensioning of the air blower in a small oil burner to the effect that the air flows through the opening in the baffle plate at the same flow rate as in a large oil burner would cause an amount of air to be supplied exceeding by far the air required for combustion. This would result in the flame temperature dropping severely and the carbon dioxide proportion in the exhaust gas becoming very small and a high proportion of the generated heat being carried away with the excessive air in an undesired manner.

On the other hand, throttling the air supply to the value for an approximately stoichiometric oxygen/fuel mixture would give an air flow having only a low flow rate. However, since the mixing effect of the burner head depends to a very large extent on the flow rate of the air, this would result in the air and the fuel being mixed incompletely. This in turn would cause the fuel to be only partly burnt, which would result in a poor efficiency, on the one hand, and a considerable soot formation, on the other hand. Another disadvantage of a large baffle plate opening and a low flow rate is that the pressure difference between the interior of the burner tube and the combustion chamber becomes very small. The relatively large opening in the baffle plate and the low positive pressure in the burner tube results in the air flow, and thus the combustion efficiency, being very largely influenced by changes in the pressure in the combustion chamber, such as are usually caused, for example, by a change in the chimney draught or by blasts of wind.

In order to provide an effective remedy for this situation and to obtain a combustion efficiency which is as good as that of conventional oil burners for high and medium heating capacities, the central opening of the baffle plate of a generic oil burner has been given a diameter of 11 to 14 mm, according to CH patent specification No. 575 573, and the air blower has been dimensioned so that it produces a positive pressure giving a water column of 32 to 36 mm. In this connection, it was already realised that for achieving an adequate combustion efficiency in oil burners for low heating capacities it is important to control the pressure ratios in the burner tube through suitable throttling of the amount of overflow of the combustion air fed by the air blower from the burner tube interior into the combustion chamber in the form of primary combustion air and secondary combustion air. For this purpose, the diameter of the central opening of the baffle plate has been limited in relation to prior art constructions to values ranging from 11 to 14 mm and the annular clearance between the burner tube outlet orifice and the outer edge of the baffle plate, which clearance serves as the passage for the secondary combustion air, has also been kept at a value that is low as compared to prior art constructions, so as to allow in this manner the available flow cross section for primary and secondary combustion air altogether to be kept adequately small.

This known solution for low heating capacity oil burners gives satisfactory results, but this applies only to oil burners with heating capacities above 18 Mcal/h. This known construction has proved to be unsatisfactory for heating capacities which are lower than this because the combustion quality as well as the efficiency drop rapidly, as trials have shown. It has therefore been assumed so far that a heating capacity of 18 Mcal/h is the lower limit for controlling an oil burner of a generic type so that there is reliably ensured an adequate combustion efficiency along with the operational, economic and ecological advantages bound up therewith.

The task underlying the invention is, while avoiding the described disadvantage, to provide with simple and low-cost means a possibility of reliably controlling the combustion efficiency in oil burners for heating capacities lower than 18 Mcal/h so that it is at least equal to the known conditions according to CH patent specification No. 575 753.

According to a first principal inventive conception directed at an oil burner for low heating capacities, this is achieved by the invention in a surprisingly simple manner by the combination of various measures taken in connection with an oil burner of generic type in that, on the one hand, the central baffle plate opening is given a minimum dimension of 10 to 15 mm and the baffle plate is arranged at a distance of its central opening from the free end face of the nozzle body of the burner nozzle which is in the region of between 3 mm at the nozzle connection end from this free end face and 5 mm at the burner tube outlet orifice end therefrom and in that, furthermore, the flow of primary combustion air passing through the central baffle plate opening is guided in such a way that at least in an edge area of the surface of this baffle plate opening this flow flows therethrough approximately vertically to this surface.

The invention starts out from the realisation, on which it is based as the general inventive conception, that for extremely low heating capacities, namely such of up to twelve Mcal/h it is not sufficient to exert an influence on the air passage cross section between the burner tube interior and the fire chamber in order to solve the problem posed but that in such low heating capacity ranges other constructional parameters, to which the experts did not until now attach any importance whatsoever, gain considerably in significance. On the one hand, this relates to the necessity of a further reduction of the lower limit for the minimum dimension of the central baffle plate opening; while keeping, however, a distance of the inlet plane of this baffle plate opening from the free end face of the nozzle body of the burner nozzle. Surprisingly, it was found that this distance does not have to be only positive, as the experts deemed necessary until now, the baffle plate being arranged at the burner tube orifice end of the free end face of the nozzle body of the burner nozzle, but that for very specific geometrical conditions there may be expedient, in the approach flow area of the primary combustion air to this baffle plate opening, a so-called "negative distance", where the inlet plane of the central baffle plate opening is situated at the nozzle connection end of the free end face of the nozzle body of the burner nozzle. A very essential parameter for attaining the desired combustion efficiency at heating capacities which are lower than the values considered just about manageable until now is the supply of the primary combustion air to the central baffle plate opening in the direction that is specific to the invention. In this respect, the invention is based on the realisation that, particularly for such low heating capacities, a thorough mixing of the combustion reactants oxygen and oil mist is essential and that the quality of this mixing process largely depends, particularly in view of the desired high air flow rates, on the fact that it occurs to the largest possible extent in the starting area of the atomisation cone of the oil mist, in other words as close as possible to the emergence thereof from the free end face of the nozzle body of the burner nozzle, and that it is disturbed to the smallest possible extent by turbulences in the area of the cone surface. The further development of this inventive conception, which is not obvious, led to the provision according to the invention that the primary combustion air passing through the central baffle plate opening is fed to the atomisation cone in the flattest possible manner over as large a surface area of this baffle plate opening as possible but at least over an edge area thereof, that is to say that its flow direction is approximately axially parallel to the burner tube at least in this edge area. Surprisingly, this measure brings about a particularly thorough mixing of the oil droplets of the atomisation cone not only in the envelope area thereof but also in the interior thereof.

It has turned out that due to the invention it is possible to attain for oil burners of the described kind, which are designed for heating capacities of as low as 12 Mcal/h, combustion ratios which are at least as good as those described in CH patent specification No. 575 573 for heating capacities ranging from 18 to 36 Mcal/h. The application of the invention is not confined to oil burners for heating capacities below 18 Mcal/h; on the contrary, the invention can also be advantageously used for higher heating capacities, for example for capacities ranging from 18 to 35 Mcal/h or even higher capacities.

It has surprisingly turned out that when such low heating capacities are involved, it is possible, in the same way as when higher heating capacities are involved, to provide a burner nozzle which is arranged in the burner tube so as to be coaxial therewith and to give the central opening of the baffle plate a circular shape and a diameter of 10 to 15 mm. However, on the other hand, for specific applications it may be expedient if, according to another inventive conception which expediently develops the invention, there are provided two burner nozzles which are symmetrical about the burner tube axis and the central opening of the baffle plate has the shape of an oval with semi-circular side areas which are coaxial with the centres of the burner nozzles and have a diameter of 10 to 15 mm. This construction allows a far-reaching adaptation to a relatively wide heating capacity range, particularly if the two burner nozzles are each conceived for a minimal oil throughput.

For the rest, a construction of the invention in which the minimum dimension of the central baffle plate opening ranges is known 'per se' manner from 12 to 13 mm has proved to be preferable for a large part of applications. In this connection, it is pointed out that in the event of the central baffle plate opening being circular, the minimum dimension thereof equals its diameter, whereas if the central baffle plate opening is formed as an oval, this minimum dimension is the vertical distance between the two longitudinal sides of the oval.

Particularly favourable flow conditions for the primary combustion air passing through the central baffle plate opening, along with a corresponding improvement of the combustion efficiency, can be provided in a constructional form of the invention wherein the baffle plate is arranged, at the burner tube orifice end of the nozzle body of the burner nozzle or burner nozzles at a distance of its central opening of 1,2 mm from the plane of the free nozzle body end face(s). It is surprisingly that this short distance between the inlet surface of the central baffle plate opening and the free end face of the burner nozzle should have such a specially favourable influence on the combustion efficiency when low heating capacities are involved. As regards the geometry of the introduction of the oil mist into the fire chamber, this distance could actually be further reduced, but it has turned out that the space for the accommodation of one or several ignition electrodes is then so limited that the danger of spark-overs towards the baffle plate or the nozzle body arises.

In a further development of the invention, a preferred constructional form is characterised, according to another subsidiary inventive conception, by the guidance of the primary combustion air flow passing through the central baffle plate opening by means of the contour of the outer surface of the nozzle body of the respective burner nozzle. In a further progressive development, the nozzle body of the burner nozzle may have a contour which tapers remote from the nozzle connection and whose tangent forms, in the transition area to the free end face of the nozzle body, with the burner tube axis an angle $\alpha$ which is between 15° and 35°, and in this connection it has turned out to be preferable if the angle of this tangent in the transition area to the free end face of the nozzle body is between 20° and 30°. It has surprisingly been shown that, provided that the measures of this invention conception are ensured, the burner nozzle may well have in known 'per se' manner an approximately frusto-spherical end area at the fire tube orifice end. Until now, it was considered impossible to use for purposes according to the invention burner nozzle having such a known contour of the outer surface of their nozzle body because the conventional constructions of such burner nozzles usually bring about a guidance of the primary combustion air flow wherein the flow lines of this combustion air extend at a relatively very steep angle to the element of the oil mist cone, thus courting the danger of pocket of turbulences arising closely behind the free end face of the nozzle body, on the one hand, and penetrating into the oil mist cone in a manner that is not very tangential, on the other hand, and therefore bringing about a relatively poor mixing effect of this primary combustion air or its oxygen content with the oil most droplet continuum. According to the invention, it will therefore be preferable to use nozzles of such known design either with an adequately small radius of the frusto-spherical end area of their nozzle body or nozzles in which, due to a relatively small axial dimension of this end area, the tangent in the transition area to the free end face of the nozzle body extends at an inclination which is within the angle range provided according to the invention. However, these difficulties are very largely avoided if, according to an inventive alternative, the burner nozzle has in known 'per se' manner a frusto-conical end area at the burner tube orifice end. In this preferred constructional form, it is possible, virtually without any manufacturing, constructional or fitting expenditure, by way of a corresponding inclination of the element of the cone of the burner nozzle body end area at the burner tube orifice end, to give the tangent in the transition area to the free end face, which practically coincides with the element of the cone of this end area of the nozzle body, the desired inclination which ensures that the flow of primary combustion air is always conducted in such a way that this air impinges virtually vertically on the inlet area of the central baffle plate opening.

It has been found that an oil burner construction according to this inventive conception and its aforedescribed advantageous further developments leads to a higher pressure drop and, as desired, to a correspondingly higher speed of the combustion air than is the case in conventional constructions, where the known burner nozzle constructions necessitate a larger diameter of the baffle plate hole and the outside diameter of the baffle plate as well as the burner tube opening therefore also have to be made larger since otherwise the flame contact surface would become too small, which would inevitably lead to an enlarged cross-sectional opening at the burner head end with the result that in such a conventional construction it is impossible to attain the desired high air pressure in the burner tube. The increased combustion air speed achievable, in contrast thereto, due to the burner head conception according to this inventive idea and its advantageous further developments, also substantially contributes to promote the mixing of combustion air an oil mist in that, surprisingly, a short-term and thorough intermixing of the oil mist and oxygen is brought about and a complete, almost stoichiometric combustion is ensured.

However, another further development of this inventive conception, which is not obvious, has likewise had proven success, and in this the free end face of the nozzle body of the burner nozzle has a diameter corresponding at the most to half of the smallest dimension of the central baffle plate opening or the diameter thereof. Experience has shown that the diameter of this free end face of the nozzle body should be approximately 5 mm. Experience has shown that this measure results in particularly good aerodynamic conditions in the burner head with a small cross-sectional opening at the burner head end, as desired, and a correspondingly high air compression in the burner tube along with a comparatively higher combustion air speed, and in this connection it has turned out that the very short sojourn time of the oil mist until its combustion can be utilised at an increased proportion for as rapid and thorough intermixing of the oil mist with the combustion air as possible, since the combustion air can act on this mixing process already in the area of the peak of the oil mist atomisation cone.

It has furthermore proved to be advantageous if the burner nozzle has, in known 'per se' manner, a hexagonal area at the nozzle connection end and if, in a further development of the last-mentioned inventive conception, the enveloping circle diameter thereof is smaller than the minimum dimension or the diameter of the central baffle plate opening. This, too, causes the aerodynamic flow geometry of the primary combustion air to be considerably promoted on the lines of attaining stoichiometric combustion conditions.

The invention is actually not confined to the inner design of the burner nozzle specifically used, particularly in view of the angle of cone of the oil mist atomisation cone produced by it, but it has surprisingly turned out that known 'per se' burner nozzles providing an oil mist outflow cone with an included angle ranging from 60° to 70° may well be used, this included angle preferably being 65°.

The measure according to another subsidiary inventive conception has provided an entirely surprising result in that it has turned out that, particularly for heating capacities below those considered until now to be just about still manageable, namely heating capacities below 18 Mcal/h, an increase in the combustion efficiency can be brought about in that the possibility of secondary combustion air flowing into the fire chamber is restricted even further in relation to the solution known from CH patent specification No. 575 573. To this end, this further inventive conception makes provision for two measures which can be used alternatively or jointly and one of which is characterised in that there is provided an annular clearance opening for the passage of secondary combustion air between the outlet orifice of the burner tube and the outer edge of the baffle plate, the width of which opening is at the most 0.5 mm in the plane of the burner tube orifice, while according to the other measure there is provided an annular clearance opening for the passage of secondary combustion air between the outlet orifice of the burner tube and the outer edge of the baffle plate, the depth of which opening is at the most 1.3 mm in the direction of the burner tube axis.

It has furthermore been shown that the burner conception according to the invention also allows the outer edge diameter of the baffle plate to range, in known 'per se' manner, from 40 to 70 mm. This means that existing oil burners can be converted in an extremely economic manner to lower heating capacities giving an excellent degree of combustion and a high efficiency according to the invention in that all that is needed is to use a baffle plate which is suitable for the purposes according to the invention and a burner nozzle imparting to the primary combustion air a flow according to the invention in a co-ordination that is specific to the invention. The same applies, of course, to the use of burner nozzles in a tandem arrangement side by side. This brings about not only easier assembly for the first equipment and for conversions but also a rationalisation of the entire manufacturing and delivery programme as regards production and storage along with the corresponding cost advantages. It has proved to be particularly preferable for the outer edge diameter of the baffle plate to range from 49 to 55 mm and to be preferably 50 mm.

Similarly, the diameter of the outlet orifice of the burner tube may range from 41 to 71 mm, the preferred range being between 50 and 56 mm and this diameter preferably being 51 mm.

In a further development of the invention, the baffle plate may be of cup-shaped design and may be arranged within the burner tube, its interior pointing to the outlet orifice of the burner tube. The baffle plate may have in known 'per se' manner a bottom section which extends approximately in the plane of its central opening and continues in a shell expanding conically towards the burner tube outlet orifice. However, improved combustion results, particularly with a view to improving the flame conduction at the combustion chamber end of the baffle plate, can surprisingly be brought about by another preferred constructional form of the invention, wherein the baffle plate has a bottom area which expands conically towards the outlet orifice of the burner tube and an edge shell which, with a more pronounced inclination, also expands towards the outlet orifice of the burner tube. It is preferred if the angle of inclination of the conically expanding bottom area of the baffle plate towards the surface of the central opening thereof ranges from 15° to 30° and preferably at 25°.

Whereas in the known baffle plate of cup-shaped design and having a flat bottom area there are provided 12 passage slots for the primary combustion air, which slots are arranged in this bottom area, provision may be made, according to an expedient further development of this inventive conception, particularly if a baffle plate of cup-shaped design is used which has a conically expanding bottom area, in the interests of a stable conduction of the flame in conjunction with an intensification of the intermixing of the primary combustion air with the oil mist continuum, particularly in the jet cone zone, so as to increase the combustion efficiency, for the central opening of the baffle plate to widen into a number of three to twelve, preferably four passage slots for the primary combustion air, which slots are recessed in a bottom area of the plate. These passage slots may open in known 'per se' manner into the central baffle plate opening either radially or inclined at an angle to the radial direction. They may furthermore be arranged in known manner so that they are inclined through 30° to 60° towards the longitudinal axis of the burner tube. Particularly if they are used in conjunction with a conically widening bottom area of the baffle plate, advantages in the conduction of the combustion can be attained, particularly for specially low heating capacities.

In a further inventive development, the passage slots may be openings which are formed by approximately strip-like zones of the baffle plate bottom area being bent in a flag-like manner from the plane of the bottom area in the direction of the outlet orifice of the burner tube. This novel baffle plate conception is not only expedient for achieving a particularly good combustion efficiency at extremely low heating capacities but also provides the advantage of an easy and economic production of the baffle plate. In this connection, it has proved to be preferable if the strip-like zones are bent from the plane of the baffle plate bottom area without being buckled. This avoids shock-free deflections of the primary combustion air flows passing through the slots, which may lead to the formation of turbulences and thus to impairments of the mixing efficiency of the primary combustion air and the oil mist in the envelope area of the jet cone. Furthermore, it has proved to be particularly preferable if the baffle plate areas bounding an opening forming a passage slot overlap one another. A value of between 0.2 and 1 mm has been established for the width of the passage slots, and in this connection it has turned out to be preferable if the width of the passage slots ranges from 0.4 to 0.5 mm. In this way, primary combustion air is fed at the fire chamber end from the baffle plate to the jet cone envelope of the oil mist at a speed that is adequate for thorough intermixing, on the one hand, and, on the other hand, it is ensured that a substantial proportion of the primary combustion air passes through the central baffle plate opening approximately in the axial direction and, in a zone of the jet cone that is particularly close to the starting area thereof, acts on this cone at a particularly flat angle of application relative to this cone and thus utilises its own speed components for pulling apart the oil droplets in the jet cone substantially in the direction of the main component of their speed and thus to contribute to a particularly thorough intermixing of the oil mist with primary combustion air.

According to another principal inventive conception, the invention also relates to a method for the operation of the oil burner according to the invention with light or extra light heating oil. This method is characterised in that a constant positive air pressure of a water column of 32 to 36 mm is maintained in the interior of the burner tube and in that the adaptation of the air supply to the oil amount to be conveyed is effected by the displacement of the baffle plate in such a way that an excess of air of a maximum of 5% by volume is provided, which corresponds to a carbon dioxide proportion in the exhaust gases of at least 15% by volume. This conduction of the method is known from CH patent specification No. 575 573 for oil burners for heating capacities from 18 Mcal/h onwards. Surprisingly, it was found by the invention that this method is not only possible in the case of lower heating capacities of down to approximately 12 Mcal/h but also provides the optimum conditions for the conduction of the combustion process for this extremely low heating capacity range. These advantages come to light particularly clearly in a burner construction according to the invention providing a frusto-conical end area of the nozzle body of the burner nozzle and a baffle plate having a conically widening bottom area, because due to the application of this known 'per se' conduction of the method another advantageous effect is surprisingly achieved on an oil burner according to the invention designed in this way, which consists in that despite the small geometrical dimensions in the area between the burner nozzle and the baffle plate and particularly the central opening thereof, there arise, due to the air compression in the burner tube which is relatively high for these small dimensions, flow rates of the primary combustion air in the area between the burner nozzle and the baffle plate which allow an expedient arrangement of the ignition electrodes at an extremely small distance from one another and from the burner nozzle body, on the one hand, as well as of the baffle plate, on the other hand, and simultaneously ensure that the ignition spark is directed into the flow direction and sparks are reliably prevented in this way from jumping on the nozzle body of the burner nozzle or the baffle plate. The advantageous consequence is not only a special uniformity of combustion with a corresponding increase in the combustion efficiency resulting in the advantageous consequences thereof in relation to the operating time, as already described, but also an improvement of the stability of the components of the burner head due to a reduction of the scaling corrosion thereof and thus, in the final analysis, a considerable increase in the total economy of such an oil burner.

Hereinafter, the invention will be described in more detail, purely by way of example, with reference to two preferred exemplified embodiments, which are shown in the drawing, and this also with respect to further features and advantages brought about by these. In the drawing:

FIG. 1 shows a longitudinal section through a burner head,

FIG. 2 shows a view of the baffle plate in the direction of vision designated II in FIG. 1, FIG. 3 shows, in a representation corresponding to that of FIG. 2, another constructional form of a baffle plate which is intended for use with two burner nozzles in a tandem arrangement, and FIG. 4 an enlarged detail section of the baffle plate along the line IV—IV shown in FIG. 2, The burner head shown in FIG. 1 and designated 3 in its entirety comprises a burner tube 4 with a section **4*b* that tapers conically as far as its outlet orifice 4*a* and a burner nozzle 5 which is coaxially arranged in the burner tube 4 and serves for atomising the oil. The diameter of the outlet orifice 4*a* ranges expediently from 41 to 71 mm and is advantageously approximately 50 to 56 mm. A diameter value of 51 mm is preferred. The burner nozzle 5, which comprises a burner connection 12 and a nozzle body 13, may advantageously be designed like that described in CH patent specification No. 553 379. The outside diameter of the burner connection 12 is, for example, 12 mm, but should be as small as ever possible. At the end that is directed towards the burner connection 12, the nozzle body 13 is provided with a hexagonal section, whose enveloping circuit diameter is smaller than the diameter of a central opening 6*a* of a baffle plate 6. Expediently, it may be smaller than the diameter of the burner connection 12. At the other end, the nozzle body 13 has a conically tapering section 13*a*, the diameter of the taper at the free front end, i.e. in the plane of the nozzle mouth, being at the most half of the diameter of the central baffle plate opening 6*a* and preferably 5 mm. The round baffle plate 6 arranged forward of the mouth of the burner nozzle 5 in the burner tube 4 is cup-shaped in design and is so arranged in the burner tube 4 that it opens in the direction that is opposite to the burner nozzle 5. It comprises a bottom area 6*c*, which conically widens away from the burner nozzle 5 at an angle of inclination $\beta$ relative to the vertical cross-sectional plane, which ranges from 15° to 30° and is preferably 25°, and has the central circular opening 6*a*, and an edge shell 6*e* which adjoins the latter towards the outside and conically widens at a more pronounced inclination in the same direction, i.e. towards the burner tube outlet orifice 4*a* and whose end forms the outer edge 6*b* of a baffle plate 6. As emerges from FIGS. 2 and 3, the bottom area 6*c* is provided with a number of passage slots 6*d* ranging from three to twelve—four in the exemplified embodiment shown—which extend from the opening 6*a* to close to the edge of the bottom area 6*c*. The passage slots 6*d* extend radially or at an angle to the radial direction and are inclined towards the direction of the longitudinal axis 14 of the burner tube 4 through approximately 30° to 60°. The diameter of the baffle plate opening 6*a* may be approximately 10 to 15 mm, however preferably 12 to 13 mm. The maximum outside diameter of the nozzle body 13 is advantageously chosen to be of the same size as or somewhat smaller than the diameter of the baffle plate opening 6*a***.

The end area **13*a* of the nozzle body 13, which tapers conically to a diameter of 5 mm of the free end face 13*b*, has a conicity whose dimension is given by the angle $\alpha$ which the tangent 17 in the transition zone to the free end face 13*b* of the nozzle body 13 forms with the burner tube axis 14. In the exemplified embodiment shown, this tangent 17 coincides with the generatrix of the conically tapering area 13*a* of the nozzle body 13. If a burner nozzle having a known 'per se' frusto-spherical end area is used, then it must be ensured that the contour thereof is such that the tangent thereon in the transition zone to the free end face also lies within an angle range provided according to the invention. This angle range for the inclination of the tangent 17 in the transition zone to the free end face 13*b* with the burner tube axis 14** or a parallel thereto is between 15° and 35°, tangent angles $\alpha$ ranging from 20° to 30° being preferred.

The baffle plate 6 is so arranged that its central opening **6*a* keeps a negative distance of up to 3 mm or a positive distance of up to 5 mm from the free nozzle body end face 13*b*. A "negative distance" is a distance which is provided when the baffle plate opening 6*a* takes up a position at the nozzle connection end of the free end face 13*b* of the nozzle body 13, while a "positive distance" is provided when this baffle plate opening 6*a* is located at the burner tube orifice end of the nozzle body 13. Particularly preferred is an arrangement of the baffle plate 6 at the burner tube orifice end at a distance a of its central opening 6*a* from the free nozzle body end face 13*b*** of 1.2 mm.

On the other hand, the baffle plate 6 is so arranged that its outer edge **6*b* is situated in the area of the tapering burner tube section 4*b* and that there is left between its outer edge 6*b* and the inner surface 4*c* of the burner tube 4 an annular gap 7, whose width b in the plane of the burner tube orifice 4*a* is at the most 0.5 mm and whose depth t in the direction of the burner tube axis 14 is at the most 1.3 mm. The outer edge diameter of the baffle plate 6 ranges from 40 to 70 mm and should preferably range from 49 to 55 mm. A baffle plate having an outer edge diameter of 50 mm is preferred. For the rest, the baffle plate 6 is held in such a way that it can be moved along the burner tube axis 14. This allows the cross-sectional space in the annular gap 7, which space is to be made available for the through-flow of secondary combustion air, to be varied within the indicated limits when the baffle plate 6 is displaced, so that the desired air compression can be adjusted in this manner in the burner tube 4. To this end, the baffle plate 6 is connected to the burner nozzle 5 by a holder which has three supporting arms 9 fastened to a sleeve 10. The sleeve 10 is displaceable on the burner connection 12, which may be provided with a graduation, and may be clamped with the aid of a screw. The supporting arms 9 are each provided with a strap 9*a* which extends approximately radially to the outside and rests against the inner face 4*c* of the cylindrical burner tube section 4*d*. By this means, the burner nozzle 5 and the baffle plate 6 are centred without substantially disturbing the air flow in the burner tube. The burner connection 12 is carried in a flange at the left-hand end of the burner tube 4, which is not shown in FIG. 1, so that it can be displaced together with the baffle plate 6 in the direction of the longitudinal axis 14. In order to facilitate the correct setting of the baffle plate 6, there may be arranged on the outside of the flange a setting device, for example a micrometer screw. In the burner head 3, there is furthermore provided an ignition electrode 15 which is indicated diagrammatically in FIG. 1**.

The burner connection 12 end that is remote from the nozzle body 13 is connected to an oil conveying device 1 by a line and the interior 8 of the burner tube 4 is connected to an air blower 2. All the air supplied by the air blower 2 is fed directly to the interior 8 of the burner tube 4 so that neither the connecting line nor the burner tube needs to have an air flap.

For the operation of the oil burner according to the invention, which is conceived for a heating capacity ranging preferably from approximately 12 to 30 Mcal/h but can also be used, without difficulty, for higher heating capacities, light or extra light fuel oil, which has, as is known, a heating value of the order of approximately 10 Mcal/kg, is fed to the burner nozzle 5 by the oil conveying device 1. Furthermore, combustion air is fed to the burner tube by the air blower 2, the air blower 2 being so dimensioned that a positive pressure giving a water column of 32 to 36 mm is formed in the interior 8 of the burner tube 4. A displacement of the baffe plate 6 now causes the annular gap 7 to be set in such a way that there is fed to the flame an amount of air which provides an approximately stoichiometric air/fuel mixture or at the most an excess of air of approximately 5% by volume. This can be detected, for example, by measuring the carbon monoxide and carbon dioxide proportion of the exhaust gases. For the operation of the oil burner, there may then be fitted an appropriate scale on the setting device serving for displacing the burner nozzle and the baffle plate. Surprisingly, the pressure in the burner tube 4 remains constant within the limits indicated above even for oil burner heating capacities below the minimum application value of the oil burner according to CH patent specification No. 575 573 of 18 Mcal/h. In particular, the essential advantage thereof is that the flow rate at which the air flows through the baffle plate opening *6a* and the annular gap 7 is approximately independent of the amount of oil conveyed, so that the burner head provides approximately the same mixing effect at every heating capacity within the indicated interval. Furthermore, the oil burner conception according to the invention causes the flow direction of the primary combustion air flow passing through the baffle plate opening *6a* to extend, at least in an edge area of this baffle plate opening, approximately vertically to the area thereof. The oil burner designed according to the invention makes it possible, even at heating capacities below 18 Mcal/h, to attain a carbon dioxide proportion which is higher than 15% by volume in the entire working zone. In a combustion in which so much air is supplied that a stoichiometric oxygen/fuel mixture is provided, the carbon dioxide proportion of the exhaust gases in the usual light and extra light fuel oils is approximately 15.7% by volume. The combustion efficiency of the oil burner designed according to the invention is thus very close to the maximum value obtainable with a stoichiometric mixture even for heating capacities below 18 Mcal/h. This has the advantage that a high flame temperature is given and that the losses caused by the heat transport of the exhaust gas are relatively small.

The detachable fastening of the baffle plate 6 to the burner nozzle 5 makes it possible to adapt the distance between the baffle plate 6 and the mouth of the burner nozzle 5 to the atomisation angle of the latter. Once the setting has been effected, the baffle plate 6 is then only displaced together with the burner nozzle 5 or the burner connection 12 thereof.

As FIGS. 2 and 4 reveal, the baffle plate 6 has another special feature as compared to conventional baffle plate constructions, in addition to its conically widening bottom area *6c*. This is to the effect that the passage slots *6d* in the bottom area *6c* are formed by apertures which are produced in that approximately strip-like areas 18 of the bottom area *6c* material are bent in an approximately flag-like and virtually buckle-free manner from the plane of this bottom area *6c* in the direction of the interior of the cup-shaped structure formed by the baffle plate 6, overlapping of the edge zones bounding the slot-shaped apertures *6d* being brought about, for example, by slight upsetting in the circumferential direction. This overlapping is designated v in FIG. 4. The width s of the passage slots *6d* should range from 0.2 to 1 mm and is preferably 0.4 to 0.5 mm.

Another constructional form of an oil burner according to the invention for particularly low heating capacities is diagrammatically shown in FIG. 3. It comprises two burner nozzles which are placed side by side in a tandem arrangement and whose nozzle body contours are particularly small, and accordingly the baffle plate 6 is provided with a central opening *6a* which has the shape of an oval, whose lateral edge zones are formed as semi-circular arcs whose diameter, which corresponds to the smallest dimension of the baffle plate opening *6a*, i.e. to the vertical distance between the two longitudinal edges thereof, ranges from 10 to 15 mm and is preferably 12 to 13 mm. In this construction form of the invention, virtually the same favourable conditions with respect to the individual operating parameters are given as in the construction described first.

We claim:

1. An oil burner including an oil conveying device, an air blower and a burner head, said burner head comprising:

a substantially cylindrical burner tube having an outlet orifice at one end, said burner tube tapering towards the orifice, a burner nozzle situated in said burner tube, said burner nozzle having a plurality of supporting arms and being tapered towards said outlet orifice of said burner tube thereby to have a frustoconical end zone at a front end thereof, and a baffle plate attached to and supported by the supporting arms of said burner nozzle, said baffle plate having a cup shape and being arranged in said burner tube in front of said burner nozzle with the interior bottom of the cup shape facing the outlet orifice of said burner tube, the cup shape of said baffle plate including a bottom zone conically widening towards the outlet orifice of said burner tube and having a central opening with a diameter equal to or larger than that of the burner nozzle and a plurality of passage slots radially outwardly extending from the central opening, said passage slots being recessed by bends in the bottom zone forming strip zones extending angularly towards the outlet orifice of said burner tube, and an edge shell around the bottom zone widening towards the outlet orifice of said burner tube so that an annular gap is defined between a front end of the edge shell of said baffle plate and the inner face of said burner tube, whereby primary air in the burner head is conducted over said frustoconical end zone of said burner nozzle mainly into the central opening of said baffle plate to flow substantially parallel to an axis of said burner tube in at least the edge zone of said central opening of said baffle plate for imparting thorough mixing of air and oil, and secondary air in the burner head is ejected through said annular gap for complete combustion of oil.

2. An oil burner according to claim 1, in which said passage slots are overlapped by the respective strip zones.

3. An oil burner according to claim 2, in which three to twelve passage slots are provided around the central opening of the bottom zone of the baffle plate.

4. An oil burner according to claim 3, in which said passage slots are inclined relative to the longitudinal axis of the burner tube from 30° to 60°.

5. An oil burner according to claim 4, in which the width of the passage slot is from 0.2 to 1 mm.

6. An oil burner according to claim 5, in which the width of the passage slot is from 0.4 to 0.5 mm.

7. An oil burner for heat capacities from 12 to 30 Mcal/h according to claim 1, in which said air blower is adapted to produce a positive pressure in the interior of the burner tube of 32 to 36 mm water, the outer edge diameter of the edge shell of the baffle plate is between 49 and 55 mm and the diameter of the central opening in the bottom zone of the baffle plate is between 12 and 13 mm, the front end of the frustoconical end zone of said burner nozzle is situated relative to said central opening in the bottom zone of the baffle plate between 3 mm at the burner nozzle side and 5 mm at the outlet orifice side of the burner tube, and the annular gap between the front end of the edge shell of the baffle plate and the inner face of the burner tube has a width no greater than 0.5 mm in the plane of the burner tube outlet orifice.

8. An oil burner according to claim 7, in which two burner nozzles are provided in the burner tube symmetrically situated about an axis of the burner tube, the central opening of the baffle plate having an oval shape with semi-circular side areas coaxial with the centers of the burner nozzles.

9. An oil burner according to claim 7, in which the front end of the frustoconical end zone of said burner nozzle is situated relative to said central opening of the baffle plate at a distance of 1.2 mm at the outlet orifice side of the burner tube.

10. An oil burner according to claim 7, in which said frustoconical end zone of the burner nozzle has a contour whose tangent relative to the axis of the burner tube forms an angle between 15° and 35°.

11. An oil burner according to claim 10, in which said angle of the tangent of the end zone of the burner nozzle relative to the axis of the burner tube is between 20° and 30°.

12. An oil burner according to claim 7, in which the front end of said burner nozzle has a diameter no greater than half of the central opening of the baffle plate.

13. An oil burner according to claim 12, in which the diameter of the front end of the burner nozzle is 5 mm.

14. An oil burner according to claim 7, in which the front end of the edge shell of the baffle plate is situated in the burner tube at a distance no greater than 1.3 mm from the front end of the burner tube.

15. An oil burner according to claim 7, in which the inclination angle of the bottom zone conically widening towards the outlet orifice of the burner tube relative to a vertical line is from 15° to 30°.

16. An oil burner according to claim 15, in which the inclination angle of the bottom zone is 25°.

* * * * *